US010336491B2

(12) United States Patent
Michels et al.

(10) Patent No.: US 10,336,491 B2
(45) Date of Patent: Jul. 2, 2019

(54) PACKAGING METHOD AND APPARATUS

(71) Applicants: Frank Michels, Kleve (DE); Enrico Czok, Kelve (DE); Markus Meunders, Emmerich (DE)

(72) Inventors: Frank Michels, Kleve (DE); Enrico Czok, Kelve (DE); Markus Meunders, Emmerich (DE)

(73) Assignee: MSK-VERPACKUNGS-SYSTEME GMBH, Kleve (DE)

( * ) Notice: Subject to any disclaimer, the term of this patent is extended or adjusted under 35 U.S.C. 154(b) by 712 days.

(21) Appl. No.: 14/306,319

(22) Filed: Jun. 17, 2014

(65) Prior Publication Data

US 2014/0373483 A1 Dec. 25, 2014

(30) Foreign Application Priority Data

Jun. 19, 2013 (EP) ..... 13172710

(51) Int. Cl.

| | |
|---|---|
| ***B65B 51/00*** | (2006.01) |
| ***B65B 51/10*** | (2006.01) |
| ***B65B 49/08*** | (2006.01) |
| ***B65B 9/02*** | (2006.01) |
| *B65B 11/10* | (2006.01) |

(52) U.S. Cl.

CPC ..... *B65B 51/10* (2013.01); *B65B 9/026* (2013.01); *B65B 49/08* (2013.01); *B65B 11/10* (2013.01)

(58) Field of Classification Search

CPC ..... B65B 53/00; B65B 53/02; B65B 51/10; B65B 9/026; B65B 49/08

USPC ..... 53/397, 442, 461, 463

See application file for complete search history.

(56) References Cited

U.S. PATENT DOCUMENTS

| | | | | |
|---|---|---|---|---|
| 3,640,048 | A * | 2/1972 | Zelnick | B65B 9/026 206/386 |
| 3,643,396 | A * | 2/1972 | Togashi | B65B 9/026 53/229 |
| 3,995,410 | A * | 12/1976 | Berghgracht | B65B 7/02 53/540 |
| 5,775,056 | A * | 7/1998 | Rauhala | B65B 11/045 53/211 |
| 9,003,744 | B2 * | 4/2015 | Hannen | B65B 9/026 53/170 |
| 2012/0096814 | A1 * | 4/2012 | Hannen | B65B 11/585 53/461 |
| 2014/0157724 | A1 * | 6/2014 | Hannen | B65B 53/02 53/442 |

* cited by examiner

*Primary Examiner* — Chelsea E Stinson
(74) *Attorney, Agent, or Firm* — Andrew Wilford

(57) ABSTRACT

An apparatus for wrapping a stack of objects vertical side faces and a horizontal top face has a unit for wrapping a film wrapper around the stack such that respective sections of the wrapper extend upward from each of the side faces. A first welder welds ends the film wrapper together at one of the side faces of the stack. A fold-over device folding the film sections over onto the top face of the stack. A second welder welds the folded-over film sections together on the top face of the stack.

9 Claims, 5 Drawing Sheets

Fig.5
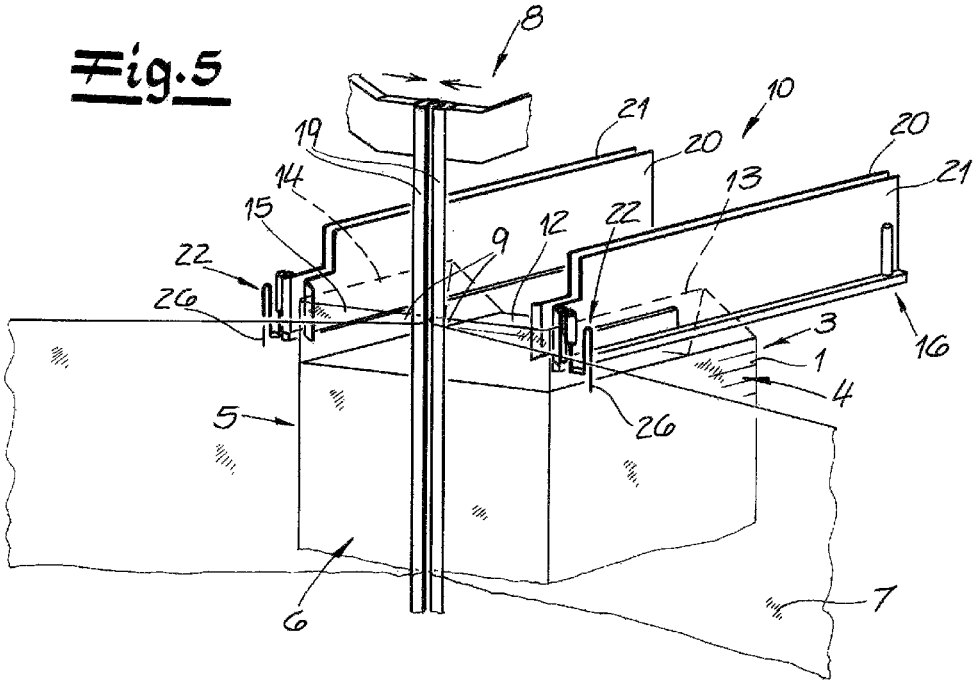
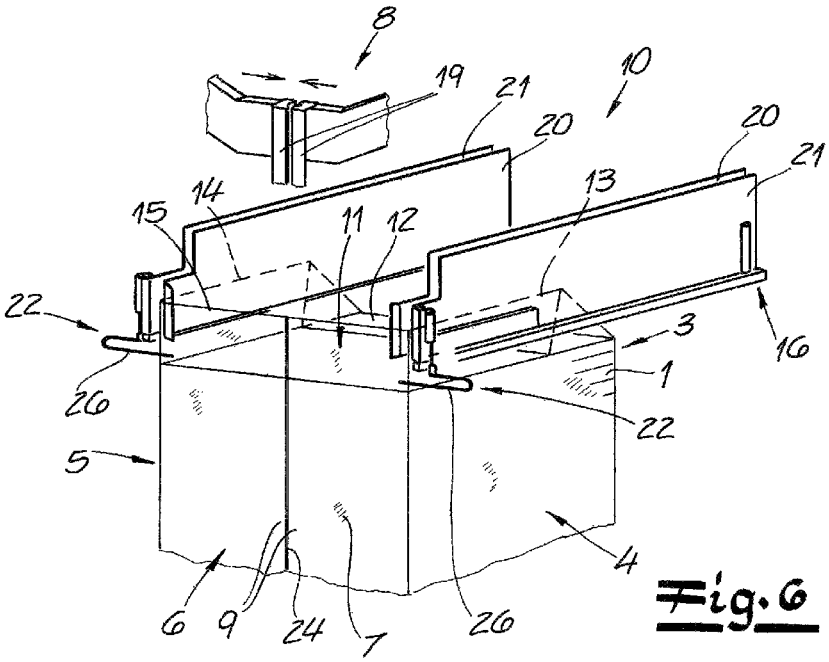
Fig.6

PACKAGING METHOD AND APPARATUS

FIELD OF THE INVENTION

The present invention relates to a packaging method and apparatus. More particularly this invention concerns the wrapping of a stack of objects with a plastic film.

BACKGROUND OF THE INVENTION

A typical apparatus for wrapping a stack of objects has a wrapping unit for wrapping the side faces of the stack with a film wrapper and at least one welder for welding two wrapper ends together at a side face. The term "stack" refers to a plurality of packages, packets, sacks or similar objects that are preferably stacked to form a parallepipedal stack having vertical side faces. According to a preferred embodiment of the invention, the stack is carried on a pallet.

An apparatus and method of the type described above are known from practice in various embodiments. With the known apparatus and method the problem exists that the stack provided with the wrapper has to be transported over a relatively great distance prior to being introduced into a shrinking device and has to pass a number of subassemblies such as rotary plates and traversing carriages. This often causes in a disadvantageous manner the wrapper to slip or to drop down on the stack before the film is shrunk. The consequences are that stacks are insufficiently wrapped up or packaged and will then for example not be able to resist much mechanical stresses during transport and storage.

OBJECTS OF THE INVENTION

It is therefore an object of the present invention to provide an improved packaging method and apparatus.

Another object is the provision of such an improved packaging method and apparatus that overcomes the above-given disadvantages, in particular that avoids the disadvantages described above.

A further object is to provide a corresponding method of wrapping a stack of objects.

SUMMARY OF THE INVENTION

An apparatus for wrapping a stack of objects vertical side faces and a horizontal top face has according to the invention a unit for wrapping a film wrapper around the stack such that respective sections of the wrapper extend upward from each of the side faces. A first welder welds ends the film wrapper together at one of the side faces of the stack. A fold-over device folding the film sections over onto the top face of the stack. A second welder welds the folded-over film sections together on the top face of the stack.

The invention relates in particular to wrapping or packaging the stack with a film wrapper that is formed of a plastic film, preferably a thermoplastic. The film wrapper or the plastic film for wrapping the stack can be heat-welded. This is an elastic film or a plastic film that may come to rest against the stack under the effect of elastic reset forces.

Instead of the term film wrapper, the shorter term wrapper will be used here and below. Insofar as the term wrapper end or wrapper ends is used within the context of the invention, this means in particular that two film portions that come to rest against the rear side face of the stack are separated from the film wrapper and are welded together. This is preferably carried out—as will be explained below—by a double welding bar or the like.

all the side faces or all the vertical side faces of the stack are covered by the film wrapper. According to a particularly preferred embodiment of the invention, the stack has a parallepipedal shape and is, if viewed from the top, rectangular. In this case, the stack to be wrapped up has four side faces, i.e. a front side face, two lateral side faces and a rear side face. A particularly preferred embodiment of the invention is characterized in that the stack to be wrapped up is carried on a pallet. A cover sheet is placed on the top side of the stack during the feeding of the stack to the wrapping unit or prior to the feeding of the stack to the wrapping unit.

Preferably, at least one conveyor for feeding the stack to the wrapping unit and for discharging the stack out of or from the wrapping unit is provided. In the case of the at least one conveyor, this is preferably an endless conveyor.

the stack is moved in the wrapping unit against a film wrapper curtain that extends transversely to the travel direction of the stack, so that the wrapper is placed against the front side face and then against the lateral side faces or against the two lateral side faces of the stack. The term front side face relates here to the side face that is foremost in the travel direction of the stack. This means that according to the invention, the placement of the film or the film wrapper is carried out as the stack is passing through the wrapping unit.

A particularly preferred embodiment of the invention is characterized in that the first welder has at least two first welding bars that can be moved against each other and that can weld two wrapper ends against the rear side face of the stack, so that the film wrapper comes to rest against the rear side face of the stack. The stack to be wrapped is conveyed into the wrapping unit or to the fold-over device using the at least one conveyor prior to the wrapper ends being welded using the first welding bar between the spread first welding bars. In this context it is preferred that the first welding bars are vertical and parallel to the vertical side edges of the stack. According to a particularly preferred embodiment of the invention, the spacing of the first welding bars can be controlled with or without feedback prior to the stack being moved into the wrapping unit. The spacing between the first welding bars is here selected such that a stack to be wrapped up can easily pass through between the welding bars. According to a preferred embodiment variant of the invention, the width of the stack and any offset of the stack is measured on the at least one conveyor using at least one sensor, and the spacing of the first welding bars is adjusted or controlled with or without feedback as a function of the measured width or of the measured offset of the stack. One or more ultrasound sensor(s) is/are used as a sensor or as sensors.

It has proven useful within the context of the invention if the first welding bars are formed as double welding bars. Thus, on the one hand a weld is formed between the two wrapper ends on the rear side face of the stack, and on the other hand another weld is provided between the remaining wrapper sections, so that again a complete wrapper curtain is available for the next stack to be fed in. Preferably, a cutter for separating the two wrapper ends from the remaining wrapper sections is provided between the respective two welding units of the double welding bars that can be moved together. A moving together of the first welding bars or the double welding bars is carried out when the stack has been completely moved into the wrapping unit.

Advantageously, the apparatus according to the invention has at least one follower member for the projecting film section of the front side face of the stack or for folding this projecting film section over onto the top face of the stack. The at least one follower member may, according to a preferred embodiment of the invention, have a film-guide member or a film-guide plate, which will be explained below. Preferably, a plurality of film-guide members or film-guide plates will be used, which will then serve as follower members for folding over the projecting film section of the front side face of the stack.

A particularly advantageous embodiment of the apparatus according to the invention is characterized in that the fold-over device includes the film-guide members that have already been described above, preferably at least two film-guide members, in particular film-guide plates, preferably at least two film-guide plates, between which the film sections projecting past the top face of the stack on the lateral side faces can be inserted or received. This means that the projecting film sections to be received between the film-guide members or the film-guide plates are film sections of the film regions or film portions that are resting against the lateral side faces of the stack. It is preferred that the insertion or reception of the projecting film sections between the film-guide members or between the film-guide plates is carried out as the stack passes through the film wrapper curtain or immediately after the wrapper or the film sections of the wrapper have come to rest against the front side face of the stack. At least 80%, preferably at least 85%, of the vertical height of the projecting film sections are received between the film-guide members or between the film-guide plates. The first welding unit or the first welding bars of the first welding means move together when the projecting film sections on the lateral side faces of the stack have been completely or substantially completely been received in respect of their length between the film-guide members or between the film-guide plates. Preferably, the film-guide members or the film-guide plates are formed as film-guide sheets made from metal or as metal sheets.

A particularly preferred embodiment of the invention is characterized in that the positioning of the film-guide members above the wrapped-up stack or the spacing of the film-guide members from the wrapped-up stack is controlled with or without feedback as a function of the height of the stack. It falls here within the scope of the invention that the height of the stack is determined by at least one sensor—in particular by at least one ultrasound sensor. The positioning of the film-guide members relative to the height of the stack is critical and the distance from the wrapped-up stack has to be adjusted accordingly.

A particularly preferred embodiment of the invention is characterized in that the fold-over device has on each of two opposite sides of the stack at least two film-guide members, in particular at least two film-guide plates, and in that between both film guiding elements/film-guide plates provided on one side of the stack, the respective film section projecting past the top face of the stack on the respective side face of the stack can be inserted or is received. The film-guide members or the film-guide plates extend over at least 80%, preferably over at least 85% of the length of the stack. The length is here measured in the travel direction of the stack.

The film-guide members or the film-guide plates can be traversed, together with the received projecting film sections, from the sides of the stack in each case to the center of the stack, so that the projecting film sections of the lateral side faces of the stack can be folded over by the film-guide members/film-guide plates toward the center of the stack onto the top face of the stack. This means that the film sections are as it were carried along by the film-guide members or the film-guide plates so as to be folded over. The traversing path of the film-guide members/film-guide plates preferably amounts to no more than 90%, particularly preferably to no more than 85% of the height of the film sections to be folded over. The height of the film sections on the lateral side faces of the stack, i.e. the excess length of the film sections above the top face of the stack, is less than half of the width of the stack or corresponds to half of the width of the stack. In this way, any overlapping of the film sections folded over onto the top face of the stack at the center of the stack is avoided.

A particularly preferred embodiment of the invention is characterized in that the fold-over device has at least one fold-over member, preferably two fold-over members, the fold-over member or the fold-over members being moved/traversed from the rear side face of the stack toward the center of the stack so that the film section projecting at the rear side face of the stack past the top face of the stack can be folded over toward the center of the stack onto the top face of the stack. The two fold-over members are provided on opposite sides of the stack and each fold-over member is associated with one half of the top face of the stack or one half of the projecting film section on the rear side face of the stack. A fold-over member is formed as a fold-over bar and the fold-over bar is preferably provided perpendicularly or substantially perpendicularly relative to the travel direction of the stack. It is preferred if the two fold-over members described above are implemented as fold-over bars. According to a particularly preferred embodiment, a fold-over bar is part of a fold-over bracket. According to a proven embodiment of the invention, the fold-over bracket or the fold-over brackets is/are of U-section. A fold-over bracket or that each fold-over bracket is fixed to a film-guide member or a film-guide plate. A fold-over bracket or each fold-over bracket can be folded down and/or can be pivoted out from the respective film-guide member or from the respective film-guide plate into the operating position or the fold-over position.

According to a particularly preferred embodiment of the invention, the fold-over device includes the second welder. In this context, the fold-over device or the second welder is preferably provided with at least one welding member that is provided or fixed to a film-guide member or to a film-guide plate. A preferred embodiment of the invention is characterized in that at least two film-guide members/film-guide plates provided on opposite sides of the stack each have at least one welding element, in particular in each case at least one second welding bar for welding the film sections folded over onto the top face of the stack. Preferably, the at least one welding element or the at least one welding bar are here respectively provided or fixed to what relative to the stack is the outer one of the film guiding elements or film-guide plates. The second welding bars are horizontal or substantially horizontal. It is recommended that the film sections folded over at the front and/or the rear side face of the stack are welded onto the film sections folded over at the side faces of the stack onto the top face of the stack. Preferably, prior to the welding of the folded-over film sections, the welding elements or the second welding bars of the film-guide members are positioned in a resting position at a small or relatively small distance from the top face of the stack. For welding the folded-over film sections, the welding elements or the second welding bars move down toward the top face or onto the top face of the stack. After the welding of the folded-over film sections on the top face of the stack, the welding elements or the second welding bars are moved back or moved up into their resting position and the wrapped-up or packaged stack is transported off.

Another subject matter of the invention is a method of wrapping a stack with a film, where the side faces of the stack are covered or wrapped up with a film wrapper, wrapper ends or two wrapper ends are welded together at a side face of the stack, and further film sections of the film resting against the side face of the stack and projecting up past the top face of the stack are folded over onto the top face of the stack, and these film sections folded over onto the top face are fused or welded together. Preferably, within the scope of the method according to the invention, a film section projecting past the top face of the stack on the front side face of the stack is folded over onto the top face of the stack by at least one follower member projecting into the conveying path of the stack. According to a particularly preferred embodiment of the invention, the at least one follower member or the follower members are a film-guide member or film-guide members. According to this embodiment, the film-guide members will then also act as follower members for folding over the film section projecting on the front side face of the stack.

A preferred embodiment of the method according to the invention is characterized in that the film sections that are opposite each other and project up past the top face of the stack on the lateral side faces of the stack are inserted between film-guide members, in particular between film-guide plates, and are folded over by the film-guide members or the film-guide plates onto the top face of the stack. Preferably, each of the two opposite sides of the stack has associated therewith a respective film-guide members or two respective film-guide plates. The two film-guide members or film-guide plates associated with a projecting film section are located at a spacing from the inserted or received film section.

A film section projecting past the top face of the stack on the rear side face of the stack can be folded over onto the top face of the stack by at least one fold-over member moved in the travel direction of the stack. Here, at least one fold-over bracket is used as a fold-over member, and particularly preferably at least two fold-over brackets are used as fold-over members.

Preferably, the wrapper ends or the two wrapper ends of the film wrapper are welded together in such a way that the weld between the wrapper ends rests against the rear side face of the stack. As has already been explained above, it is particularly preferred within the scope of the method according to the invention if two double welding bars are used for welding the wrapper ends.

The invention is based on the realization that the apparatus according to the invention and the method according to the invention can be used to make a very effective and functionally safe and long-lasting wrapping or packaging of a stack. The wrapping can here be realized with relatively little effort, and also the apparatus according to the invention that is required for this is designed so as to be low in complexity and cost. The stack wrapped up or packaged using the measures according to the invention can readily accommodate certain mechanical stresses without the wrapping being caused to slip, separate or get damaged. In so far various transport movements can be carried out with the stack wrapped up according to the invention, in particular on rotary plates and/or on traversing carriages or the like, without the wrapping being adversely impacted. The products stacked in the stack remain effectively secured in the long term. It has to be pointed out that the apparatus according to the invention and the method according to the invention can be realized at relatively low costs. It is further to be pointed out that the folding over of the projecting film sections can be carried out in a clean and tidy manner using the measures according to the invention, so that also the subsequent welding of the folded-over film sections with each other or with a cover sheet placed on the top face of the stack can be carried out in a clean and precise manner. As a result this avoids that any unwanted capillaries for humidity are created, and an optimum water-tightness of the packaging is ensured. Consequently, a stack treated using the measures according to the invention will, after the shrinking, have a tidy and water-tight shrinkage design.

BRIEF DESCRIPTION OF THE DRAWING

The above and other objects, features, and advantages will become more readily apparent from the following description, reference being made to the accompanying drawing in which:

FIGS. 3 to 10 are schematic views showing a top region of the apparatus according to the invention in the second through ninth steps of the method.

SPECIFIC DESCRIPTION OF THE INVENTION

Figure 1:
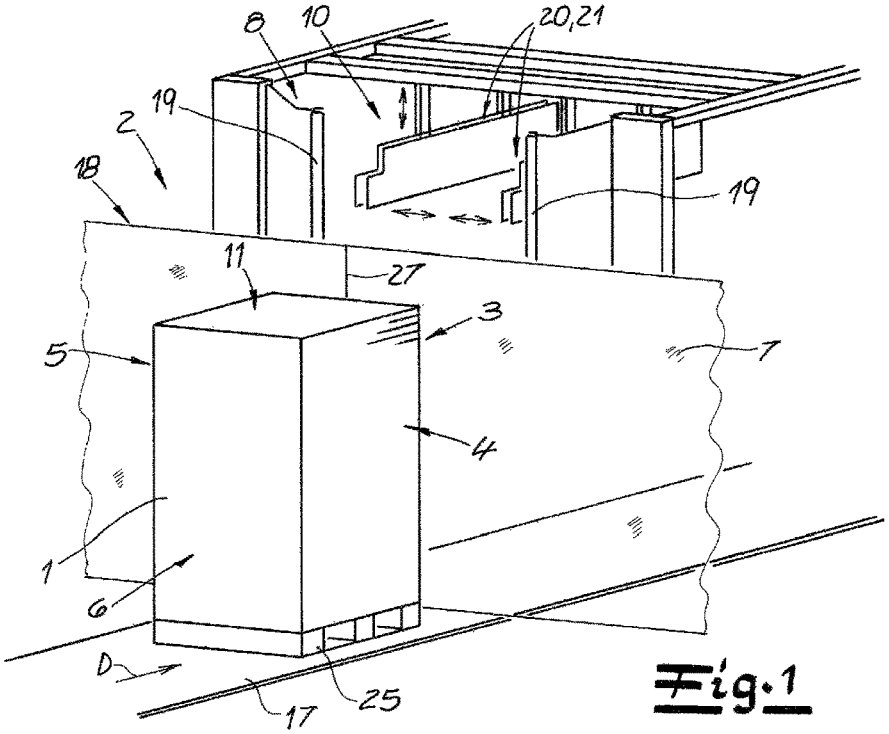
FIG. 1 is a schematic perspective view of an apparatus for wrapping a stack 1.
Figure 2:
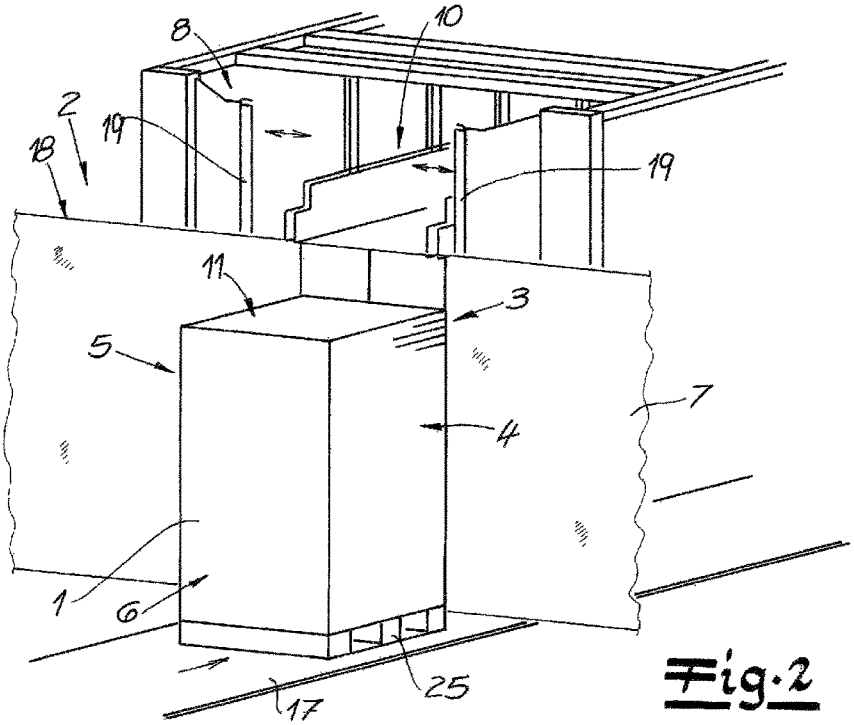
FIG. 2 is a schematic view of the apparatus of FIG. 1 in a first functional position.

As seen in FIG. 1, an apparatus according to the invention for wrapping a stack 1 of objects, where a wrapping unit 2 for wrapping side faces 3, 4, 5, 6 of the stack 1 with a film wrapper 7 is provided. It can be seen in particular when comparing FIGS. 1 and 2 that the stack 1 in the wrapping unit 2 is preferably, and in this embodiment, fed against a film wrapper curtain 18 extending transversely to a horizontal travel direction D of the stack 1, so that the film wrapper 7 will initially make contact with the leading or front side face 3 and then the two lateral side faces 4 and 5 of the stack 1, which themselves extend vertically and parallel to the direction D. In this embodiment, the stack 1 is moreover transported by at least one conveyor 17 in the travel direction D into, through, and out of the wrapping unit 2. In this embodiment, the stack 1 is parallepipedal with a top face 11 as well as the four side faces 3, 4, 5, 6. Here, the stack 1 is transported on a pallet 25. Further, preferably and in this embodiment, the film wrapper 7 is a weldable thermoplastic film.

In the travel direction D downstream of the stack 1 to be wrapped, a first welder 8 is provided in the form of two double welding bars 19 for welding two wrapper ends 9 at the trailing or rear side face 6 of the stack 1. Here, once the film wrapper 7 rests against the front side face 3 and on the lateral side faces 4 and 5 of the stack 1, the two double welding bars 19 of the first welder 8 are pivoted together. These double welding bars 19 are used to form a weld 24 between the two wrapper ends 9 to be welded on the rear side face 6 of the stack 1. Preferably the two double welding bars 19 of the first welder 8 are vertical and parallel to the vertical side edges of the stack 1. The bars 19 are doubled so as to form a second weld 27 at the same time as the first weld 26, and an unillustrated cutter is provided that severs the film between the welds 26 and 27, so that the second weld 27 is left holding together the two strips 9 forming the curtain 18 and that will come to lie against the center of the leading or front side face 3 of the next stack 1.

The width of the stack 1 and any displacement of the stack 1 on the conveyor 17 are measured between the two spread double welding bars 19. This has not been shown in any more detail in the figures and this measurement is preferably carried out using at least one sensor, in particular at least one ultrasound sensor. As a result, the spacing between the double welding bars 19 can be controlled with or without feedback, so that the stack 1 can easily be passed through between the double welding bars 19.

Figure 3:
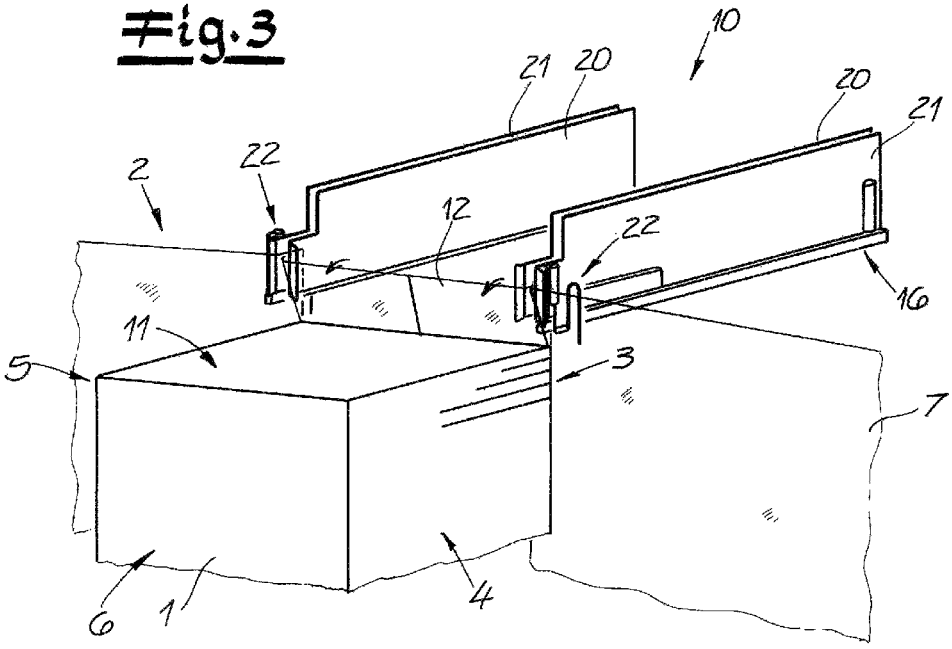
Figure 4:
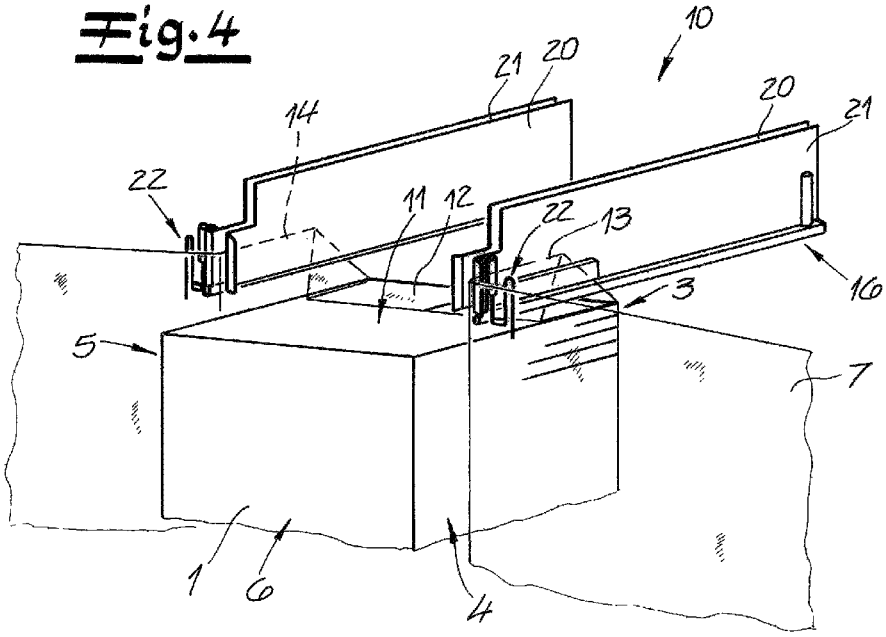

Sections 12, 13, 14, and 15 of the film wrapper 7 initially project up from the side faces 3, 4, 5, and 6 past the top face 11 of the stack 1, in particular vertically or substantially vertically. In addition as shown in FIGS. 3 and 4 when the stack 1 is moved into the wrapping unit 2, the projecting film section 12 of the front side face 3 is laid back or folded over by a following member onto the top face 11 of the stack 1 toward the center of the stack 1. Preferably and in this embodiment, first and second pairs of film-guide plates 20 and 21 of the fold-over device 10, as will be explained below, act as follower members for folding over the front film section 12 toward the center of the stack 1. Moreover, the height of a stack 1 fed to the wrapping unit 2 or the fold-over device 10 is measured using at least one sensor, in particular using at least one ultrasound sensor. Thus, as the stack 1 moves in, the spacing of the film-guide plates 20 and 21 is adjusted toward the top face 11 of the stack 1. Preferably and in this embodiment, the film-guide plates 20 and 21 are formed of metal sheets.

According to this embodiment, the fold-over device 10 of the apparatus according to the invention has two of the film-guide plates 20 and 21 on each of the two opposite lateral sides 4 and 5 of the stack 1 (see in particular FIGS. 3 to 5). A respective film section 13 and 14 projects from each of the side faces 4 and 5 of the stack 1 past the top face 11 of the stack 1 and up between the respective film-guide plates 20 and 21 to be inserted or received in the fold-over device 10 while the stack 1 is being moved in. In the course of this, here the projecting film sections 13 and 14 are received between the film-guide plates 20 and 21 over the entire length of the film-guide plates 20 and 21 and are spaced from the film-guide plates 20 and 21. This completely received condition of the projecting film sections 13 and 14 is particularly shown in FIG. 6.

According to a preferred embodiment of the invention and in this embodiment, once the film sections 13 and 14 projecting up from the side faces 4 and 5 have been received between the respective pairs of film-guide plates 20 and 21, the two double welding bars 19 of the first welder 8 are initially moved together, as described above. The at least one fold-over member or the at least one fold-over bar is subsequently moved into position for the later folding over of the film sections 15 projecting on the rear side face 6 of the stack 1 at the downstream end of the top face 11. Here, two fold-over members or two fold-over bars 26 are brought into position for this folding over to be carried out later. In the course of this, here the fold-over bars 26 are respectively connected to what relative to the stack 1 are the outer film-guide plates 21 and are pivoted away from the respective film-guide plates 21 into the fold-over position. Preferably and in this embodiment, the fold-over bars 26 each form a U-leg of a U-shaped fold-over bracket 22 fixed to the trailing end of the outer respective film-guide plate 21 and pivoted away or downward from this outer film-guide plate 21 into the fold-over position. In this respect, reference is moreover made to a comparison between FIGS. 5 and 6.

Figure 7:
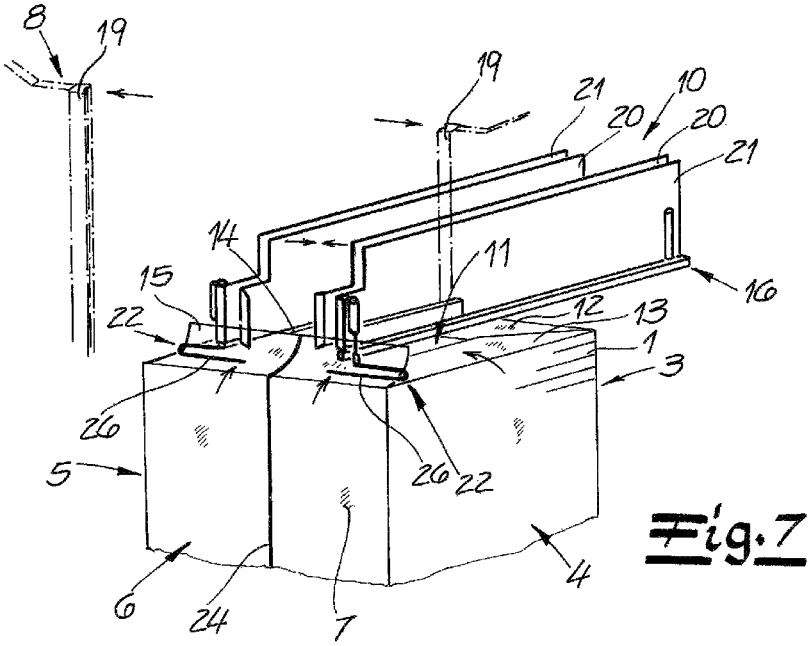
Figure 8:
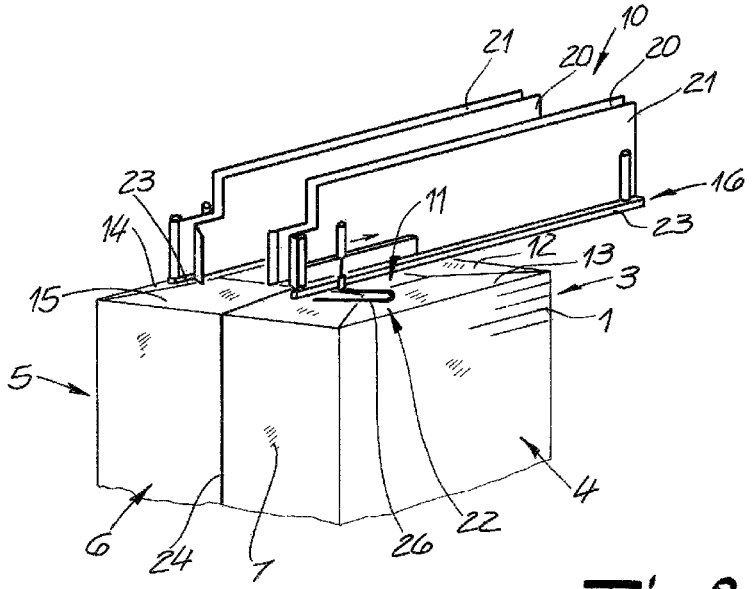
Figure 9:
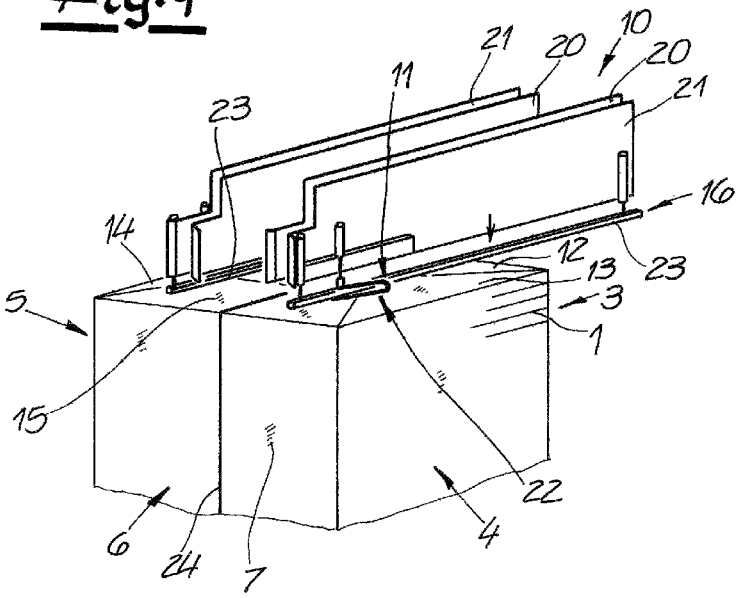
Figure 10:
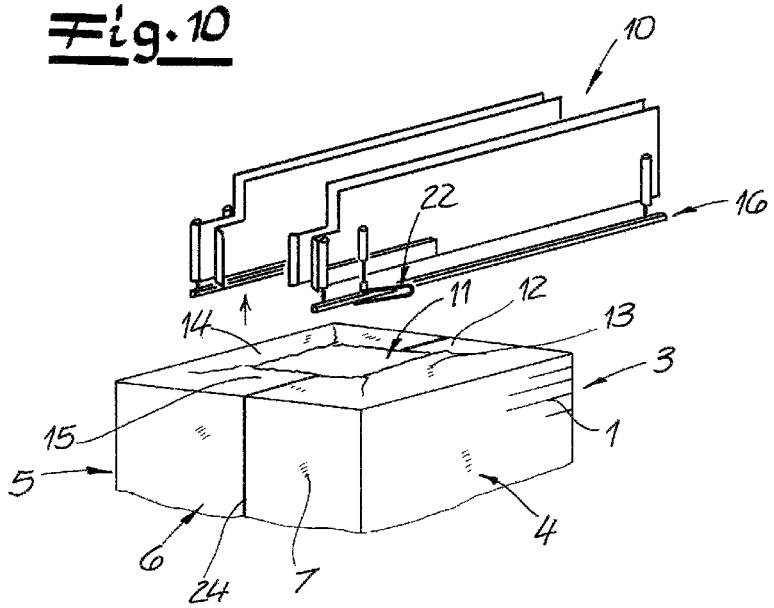

According to a proven embodiment of the invention, once the two double welding bars 19 have been moved together and the fold-over bars 26 or the fold-over brackets 22 have preferably been pivoted into position, the film sections 13 and 14 projecting on the side faces 4 and 5 are subsequently folded over onto the top face 11 of the stack 1. To this end, according to a preferred embodiment of the invention, the two pairs of film-guide plates 20 and 21 move synchronously toward the center of the stack 1 or toward the center of the top face 11. It goes without saying that while this is happening, the film-guide plates 20 and 21 will always be at a sufficient spacing from the top face 11 of the stack 1. This means that as a result of this movement of the two pairs of film-guide plates 20 and 21, the film sections 13 and 14 received between the film-guide plates 20 and 21 are folded onto the top face 11. The path traversed by the film-guide plates 20 and 21 when moving toward the center of the top face 11 of the stack 1 amounts to approximately 75 to 85%, preferably approximately 80% of the height of the film overhang 13 and 14. The pairs of film-guide plates 20 and 21 will then preferably initially remain in a position above the center of the top face 11 of the stack 1. With regard to moving the two pairs of film-guide plates 20 and 21 together, reference is moreover made to a comparison between FIGS. 6 and 7. Here, the two double welding bars 19 of the first welder 8 will then subsequently be moved apart.

As the two fold-over brackets 22 travel along with the respective outer film-guide plates 21 toward the center of the stack 1, the fold-over bars 26 of the two fold-over brackets 22 are moved into the space between the film-guide plates 20 and 21 and the top face 11 of the stack 1. As a result of the application of the fold-over bars 26 of the fold-over brackets 22, the film section 15 projecting on the rear side face 6 of the stack 1 past the top face 11 is folded over onto the top face 11 of the stack 1. Here, the fold-over brackets 22 are then pivoted against the respective outer film-guide plates 21 so that the fold-over bars 26 get out of the space between the film-guide plates 20 and 21 and the top face 11 of the stack 1.

In this embodiment and according to a preferred embodiment of the invention, the film sections 12, 13, 14, and 15 folded onto the top face 11 of the stack 1 will subsequently be fused or welded together. Here, the fold-over device 10 of the apparatus according to the invention includes a second welder 16 in the form of two horizontal welding bars 23 each provided or fixed on a respective one of the outer film-guide plates 21. By moving these horizontal welding bars 23 down onto the top face 11 of the stack 1, the film sections 12, 13, 14, and 15 folded over onto the top face 11 of the stack 1 can be welded together or to one another. Both the front folded-over film section and the rear folded-over film section 15 are welded with the lateral folded-over film sections 13 and 14. After this welding of the film sections 12, 13, 14, and 15 on the top face 11 of the stack 1, the wrapped-up stack 1 is transported off by the conveyor 17 from the wrapping unit 2 or out of the fold-over device 10.

We claim:

1. An apparatus for wrapping a stack of objects having, relative to a horizontal and longitudinal travel direction, first and second transversely spaced and vertical side faces extending parallel to the direction, a vertical front face transversely bridging front ends of the side faces, a vertical rear face transversely bridging rear ends of the side faces, and a horizontal top face extending between upper ends of the front, rear and side faces, the apparatus comprising:

at least one conveyor for advancing the stack in the horizontal and longitudinal travel direction;

means for wrapping a film wrapper around the stack such that respective first side, second side, front, and rear film sections of the film wrapper extend upward from the respective faces past the top face;

a first welder for welding ends of the film wrapper at one of the faces of the stack;

a fold-over device having first and second pairs of transversely spaced, parallel, and upright film-guide plates all extending parallel to the travel direction, the plates of each pair being transversely fixed to each other and jointly transversely movable from an outer position above the respective side face and with the first pair of guide plates confronting the second pair of guide plates perpendicular to the direction into an inner position with the two pairs of plates closely juxtaposed centrally above the stack, the two pairs of plates being so oriented that in the outer position the first and second side film sections project up from the respective first and second side faces of the stack past the top face and are received between the guide plates of the respective first and second pairs, the first and second pairs of plates being movable transversely of the direction toward one another from the outer position for pulling the respective first and second side film sections from between the respective plates and laying the first and second side film sections onto the top face of the stack;

respective first and second fold-over members on the first and second pairs of film-guide plates and movable in the travel direction from downstream of the rear face to fold the rear film section over onto the top face of the stack; and a second welder for welding the folded-over film sections onto the top face of the stack.

2. The wrapping apparatus defined in claim 1, wherein in the wrapping means the film wrapper is arrayed as a film wrapper curtain extending transversely to the travel direction of the stack such that as the conveyor advances the stack through the wrapping means the film wrapper comes to rest against the front face and then against the lateral side faces of the stack.

3. The wrapping apparatus defined in claim 1, wherein the first welder includes at least two first welding bars that can be moved relative to each other to pinch the film wrapper together immediately downstream of the stack and weld the wrapper together at the rear side face of the stack.

4. The wrapping apparatus defined in claim 1, wherein the fold-over device is provided with the second welder for welding the folded-over sections of the film together on the top face.

5. The wrapping apparatus defined in claim 4, wherein the second welder includes a second welding bar.

6. The wrapping apparatus defined in claim 1, wherein the fold-over device folds back the first section projecting upward from the front side face against the travel direction, bends inward the first and second lateral sections projecting up from the lateral side faces transverse to the direction and toward each other, and bends the rear section projecting up from the rear side face forward in the direction.

7. The wrapping apparatus defined in claim 1, wherein the front section extending upward from the front face 3 is folded downward by engagement with downstream ends of the guide plates.

8. The wrapping apparatus defined in claim 1, further comprising:

at least one welding bar engageable downward with the sections atop the top face.

9. The wrapping apparatus defined in claim 1, further comprising:

welding bars for welding the film wrapper together downstream of the stack in a pair of vertical seams generally at a center of the rear side face such that one of the seams lies against the rear side face, and means for cutting the film wrapper between the pair of seams such that the other of the seams aligns with a center of the front side face of another stack moving in the direction.

* * * * *